United States Patent [19]

Freeman, Jr.

[11] Patent Number: 4,709,461

[45] Date of Patent: Dec. 1, 1987

[54] METHOD OF FORMING DENSE INGOTS HAVING A FINE EQUIAXED GRAIN STRUCTURE

[75] Inventor: William R. Freeman, Jr., Easton, Conn.

[73] Assignee: Howmet Turbine Components Corporation, Greenwich, Conn.

[21] Appl. No.: 827,541

[22] Filed: Feb. 10, 1986

[51] Int. Cl.[4] ..... B23P 17/00

[52] U.S. Cl. ..... 29/526.3; 29/527.5; 29/527.6; 164/122; 164/125; 164/136

[58] Field of Search ..... 164/76.1, 69.1, 122, 164/125, 136; 29/526.3, 527.5, 527.6

[56] References Cited

U.S. PATENT DOCUMENTS

| | | | |
|---|---|---|---|
| 444,381 | 1/1891 | Hinsdale | 164/136 X |
| 448,881 | 3/1891 | Hinsdale | 164/122 |
| 3,570,713 | 3/1971 | Tromel | 164/122 X |
| 4,021,910 | 5/1977 | Freeman, Jr. et al. | 29/526.3 X |
| 4,054,170 | 10/1977 | Kraai et al. | 164/125 X |
| 4,580,616 | 4/1986 | Watts | 164/122 X |

FOREIGN PATENT DOCUMENTS

| | | | |
|---|---|---|---|
| 287244 | 2/1971 | U.S.S.R. | 164/122 |

*Primary Examiner*—Nicholas P. Godici
*Assistant Examiner*—J. Reed Batten, Jr.
*Attorney, Agent, or Firm*—Finnegan, Henderson, Farabow, Garrett & Dunner

[57] ABSTRACT

A method of forming a fine grained equiaxed ingot by melting metal and placing it in a mold having a restriction at the entrance disposed to solidify the metal in the entrance to the mold prior to complete solidification of the metal in the mold such that a shrinkage void is formed below the entrance to the mold. The ingot is then hot isostatically pressed (HIPped) to fully densify the ingot and eliminate the shrinkage void.

16 Claims, 4 Drawing Figures

METHOD OF FORMING DENSE INGOTS HAVING A FINE EQUIAXED GRAIN STRUCTURE

BACKGROUND OF THE INVENTION

The present invention relates to a method of forming high density fine equiaxed grain ingots from molten metals.

Early wrought superalloys were produced by conventional ingot and hot working technologies. The need for improved properties, primarily in the aerospace propulsion industry, eventually became increasingly difficult to produce in large sizes without significant chemical and microstructural segregation, particularly along the ingot centerline where the metal freezes last. This undesirable condition not only affected forgeability, but also affected the resultant properties of the forgings containing this type of structure.

A conventionally produced casting contains a combination of columnar and coarse equiaxed grains and the resulting grain size of a casting generally is larger as the size of the casting increases. This increases the forces required to forge the material and also the tendency for cracking during hot working operations.

A solution to these problems was the successful adaptation of powder metallurgy approaches to the manufacture of uniform grained and chemically homogenous products which responded well to forging practice. Furthermore, it developed that such fine grained materials (e.g., ASTM 10–12) were superplastic when deformed at preferred temperatures and strain rates which enabled the production of very near net shapes with relatively modest deformation forces. The fine grain size improves overall forgeability, improves the response to heat treatment and allows the utilization of isothermal forging procedures. While the latter operation is slow and ties up high capital cost equipment, it has the ability to produce products nearly to final shape and thus avoid the waste and associated machining costs attendant with the removal of excess stock.

The production of articles from metal powders, however, is not without technical shortcomings, especially with respect to superalloys. Superalloy powders usually are produced by atomization in an inert atmosphere and subsequent screening to remove all but the preferred particle sizes. As cleanliness demands have increased, more of the coarser particle fractions are discarded to satisfy this requirement. Typically, 60% yields are expected for the process and this represents a significant premium cost factor for the product. This has inhibited widespread use of such materials where cost is a significant factor.

In addition, superalloy powder metallurgy products are susceptible to quality related problems which can reduce substantially the mechanical properties of the product. These include boundary conditions related to the original powder surface and thermally induced porosity resulting from trapped atomizing and handling gas (e.g., argon). Process controls necessary to avoid these problems can present a substantial expense. Thus, if a casting process could be developed which produces a chemically homogeneous, fine grained and sound product, an alternative to the powder metallurgy process might be realized with lower manufacturing cost.

As noted above, the finer grain size of the article produced, the better is its forgeability and the associated economics of production are enhanced. Investment castings usually benefit by having the finest possible grains to produce a more uniform product and improved properties, thus it is conventional to control and refine the grain size of the casting through the use of nucleants on the interior surface of the mold. While this produces a degree of grain refinement, the effect is substantially two dimensional and the grains usually are elongated in the direction normal to the mold-metal interface. This condition also occurs without a nucleant where metallic ingot molds are used. In either instance combined use of low metal superheat and low mold temperature, both at the time of pouring, are means by which the grain size can be refined; however, the resultant microstructure remains dendritic and characteristic of traditional foundry processing. The most desirable microstructure would be, in addition to minimum grain size, the presence of a cellular, or nondendritic, structure to facilitate thermal processing procedures. Such a microstructure would normally result from a high nucleation and freezing rate of the molten metal at the time of casting. Means for achieving this product are described in U.S. Pat. Nos. 3,847,205, 3,920,062 and 4,261,412. Using the techniques disclosed in these references, grain sizes of ASTM 3–5 can be readily achieved.

Other techniques have been employed to refine grain size in both investment casting and ingot manufacture which include the addition of finely distributed solid particles within the melt as nucleation sites. This has found little favor with superalloy users because of undesired compositional changes or the possibility that residual foreign material may provide sites at which premature failure may initiate. Alternatively, the molten alloy may be stirred mechanically, such as in rheocasting, to refine its grain size. This often results in a nondendritic structure containing two components—closely spaced islands of solid surrounded by a matrix of material which remains liquid when the mixing is discontinued—which usually occurs when viscosity increases abruptly at about 50% solidification. This process works well with lower melting point materials. It has not been successful on a commercial scale with superalloys due to their high melting point and the fact that the ceramic paddles or agitators are a source of potential contamination of the melt in the ingot manufacturing process.

A more desirable method involves the seeding of the melt as described in U.S. Pat. No. 3,662,810. A related technique, described in U.S. Pat. No. 3,669,180 employs the principle of cooling the alloy to the freezing point to allow nuclei to form, followed by reheating slightly just before the casting operation. If in doing this isolated grains nucleate and grow dendritically in the melt, they may not fully remelt upon reheating thus producing random coarser grains in the final product. Both procedures work but require sophisticated control procedures. In addition, neither address the problem of alloy cleanliness, or inclusion content. This requirement has grown in importance as metallurgical state-of-the-art improvements are made and product design limits are advanced.

Whether casting in an ingot mold or an investment shell it is normal to see a characteristic array of grain structures from the surface to the core of a casting. Adjacent to the surface it is customary to observe a chill zone which usually is nondendritic in nature. Immediately below this zone area are columnar dendritic grains lying normal to the surface and parallel to heat flow. One would expect to find a coarse dendritic equiaxed structure below the columnar zone contrary to that observed by this casting practice. The aforementioned columnar condition is unsatisfactory in an investment casting and must be removed by machining or other means from an ingot surface before forging operations are initiated. Failure to do this will cause premature cracking during forging reductions.

In U.S. Pat. application Ser. No. 783,369, filed Oct. 3, 1985, there is disclosed a method of forming cast metal articles having a fine-grained equiaxed grain structure by casting the molten metal with very little superheat. Such a casting technique is, in a manner similar to conventional casting techniques, susceptible to the formation of a shrinkage void and centerline porosity. Conventional casting practice is to provide a molten metal reservoir in flow communication with the location of the shrinkage void or to locally heat the portion of the casting to last solidify such that molten metal is fed into the area where a void would ordinarily form. Such a technique is not feasible where a unique fine grained casting is to be produced because it is difficult to maintain a reservoir of molten metal in flow communication with the site of a shrinkage void at a very low superheat. Even if molten metal could be fed to the portion of the casting that would have been a shrinkage void, it would have a relatively large grain size. This gives the resulting casting non-uniform properties and limits the potential uses of the casting.

Without a source of molten metal feeding the top of the casting shrinkage voids or a "pipe" may form at the centerline of the casting due to the contraction of metals upon solidification and the low rate of solidification. Without a reservoir of molten metal to fill the resultant void, it remains and is open to the top of the casting. As a result, the void cannot be eliminated by hot isostatic pressing (HIPping) without some additional step of closing the connection between the void and the surrounding atmosphere, as for example, by canning the resulting casting.

In addition, in multi-component alloys the solidification of the alloy may result in the last molten metal that solidifies last having a composition different from that of the overall alloy composition. This produces a non-uniform casting.

It is, therefore, an object of the invention to provide a method for the casting of cellular fine grained ingots in which the above disadvantages may be obviated.

Specifically, it is an object of the invention to provide a cast ingot having equiaxed, cellular, non-dendritic microstructure uniformly throughout the ingot.

It is a further object of the invention to provide castings having no surface connected porosity such that HIPping of the casting can be successfully employed to eliminate any casting porosity.

Other objects and advantages of the invention may be set out in the description that follows, may be apparent therefrom or may be learned by practice of the invention.

SUMMARY OF THE INVENTION

To achieve these and other objects of the present invention, there is comprised a method for casting a metal article. In the method a metal is melted with the temperature of the molten metal preferably being reduced to remove almost all of the superheat in the molten metal. The molten metal is placed in a mold that includes means for accelerating solidification of the metal at the entrance to the mold. The entrance to the mold is blocked by solidifying the metal in the entrance before solidification is complete in the remainder of the mold. The metal is then solidified in the mold by extracting heat from the mixture at a rate to solidify the molten metal to form the ingot having a substantially equiaxed cellular microstructure uniformly throughout. The ingot so formed has a shrinkage void beneath the blocked entrance to the mold. The cast ingot is then hot isostatically pressed to eliminate voids in the casting.

The basic method disclosed above can be altered by inverting the ingot after the entrance to the mold is blocked and a major portion of the metal is solidified. In such a method, the minor portion of molten metal flows into the shrinkage void. The molten metal flowing into the shrinkage void is solidified therein and after HIPping the ingot, the solidified portion is trimmed from the remainder of the ingot.

The above variation of the basic method can also be varied by mixing the minor portion of molten metal that is placed in the shrinkage void by inverting the ingot. This reduces segregation of the metal in that portion of the ingot. In this variation of the method, the ingot need not be trimmed to eliminate the portion last solidified because there has been no segregation.

DESCRIPTION OF THE PREFERRED EMBODIMENTS

Figure 1:
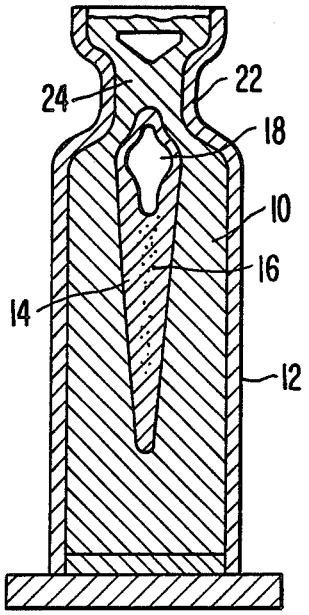
FIGS. 1–4 are schematic cross-sectional drawings of ingot molds depicting various means of practicing the present invention.

The present invention is a method for casting a metal ingot having a substantially equiaxed, cellular, nondendritic microstructure uniformly throughout the ingot.

The present invention finds particular utility for superalloys for the reasons set out in the Background of the Invention portion of the present specification. The process is, however, not limited to any particular material but by way of illustration finds particular utility in forming metal ingots of the following materials:

| | Composition w/o | | | | | | | | | | | | | |
|---|---|---|---|---|---|---|---|---|---|---|---|---|---|---|
| Common Name | Cr | Co | Mo | W | Ta | Cb | Al | Ti | C | B | Zr | Hf | Fe | Ni |
| Rene 95 | 14 | 8 | 3.5 | 3.5 | — | 3.5 | 3.5 | 2.5 | 0.04 | 0.01 | 0.05 | — | — | Bal |
| MERL 76 | 12.4 | 18.5 | 3.2 | — | — | 1.4 | 5 | 4.3 | 0.02 | 0.02 | 0.05 | 0.4 | — | Bal |
| C 101 | 12.4 | 9 | 1.9 | 3.8 | 3.9 | — | 3.4 | 4.1 | 0.12 | 0.02 | 0.05 | 1 | — | Bal |
| IN 718 | 19 | — | 3 | — | — | 5.1 | 0.5 | 0.9 | 0.04 | 0.01 | 0.05 | — | 18.5 | Bal |
| MARM 247 | 8.5 | 10 | 0.75 | 10 | 3 | — | 5.5 | 1 | 0.15 | 0.01 | 0.05 | 1.5 | — | Bal |
| IN 713C | 13 | — | 4.5 | — | — | 2 | 6 | 0.8 | 0.12 | 0.01 | 0.05 | — | — | Bal |
| U720 | 18.2 | 14.8 | 3.1 | 1.2 | — | — | 2.48 | 4.99 | 0.04 | 0.03 | 0.03 | — | 0.39 | Bal |
| ASTM F75 | 28 | Bal | 6 | — | — | — | — | — | 0.25 | — | — | — | — | — |
| 17-4 PH* | 16 | — | — | — | — | 0.25 | — | — | 0.03 | — | — | — | Bal | 4 |
| Custom 450** | 14.8 | — | 0.8 | — | — | 0.4 | — | — | 0.03 | — | — | — | Bal | 6.5 |

-continued

| Common Name | Composition w/o | | | | | | | | | | | | | |
|---|---|---|---|---|---|---|---|---|---|---|---|---|---|---|
| | Cr | Co | Mo | W | Ta | Cb | Al | Ti | C | B | Zr | Hf | Fe | Ni |
| 316 Stainless | 17 | — | 2.5 | — | — | — | — | — | 0.04 | — | — | — | Bal | 12 |

*Also 3 Cu.
**Also 1.75 Cu.

Use of the present invention with these materials has determined that single phase materials may not retain the fine grain size initially produced by the process due to the lack of a second phase that would pin the grain boundaries. This problem was observed for the martensitic stainless steels set out above, namely 17–4 PH and Custom 450. Such materials may still be operable with the present invention if some means of pinning the grain boundaries of the as-cast material is included in the composition or if some other means of retaining the as-cast grain structure is utilized or if a somewhat coarser grain size can be tolerated. The austenitic stainless steels, e.g., Type 316, have sufficient carbides that grain growth after solidification is inhibited and the beneficial structure of the as-cast material is retained.

After solidification, some of these materials need special cooling cycles in order to prevent grain coarsening. Nickel alloys may require rapid cooling below the solidus to about 2150° F., except for IN 718 which should be rapidly cooled to below 2050° F. This rapid cooling prevents detrimental recrystallization and grain growth by solid state processes in the cast material.

The first step in the process of the present invention is melting the metal. This may be done in an inert atmosphere or vacuum depending on the requirements of the metal system being cast. Where the metal system requires an inert or vacuum atmosphere, conventional vacuum induction casting equipment may be employed.

Preferably the molten metal is held in a substantially quiescent state. When heating the melt using induction heating techniques first prior to casting, stirring of the melt should be minimized. This can be done by means of selecting the frequency of the induction field. Where the melt is turbulent or stirred in the pouring crucible undesirable non-metallic impurities are entrained in the melt rather than being isolated at specific locations in the melt. With the non-metallics isolated, the casting process can be selected such that any impurities are kept from the useful portion of the casting.

Where cleanliness of the melt is imperative a crucible heated by a separate susceptor or resistance heater may be used in order to obtain the desired melt temperature without stirring the molten metal.

There are special considerations that must be taken in using such equipment because of the very low superheat of the material being cast. At such low superheats the surface of the molten metal tends to freeze off in the melting crucible due to radiation heat losses. Depending on the equipment design, a small area should remain liquid at the melt surface and preferably at the centerline when the preferred casting conditions are met. The molten metal may be poured through this opening at a rapid rate into the properly positioned mold. It is at this opening that temperature measurements associated with the invention are made. Before the next charge can be melted, however, this skull of solidified material should be remelted or otherwise removed before another alloy charge may be cast. Alternatively, a replaceable crucible liner may be employed to avoid this problem.

An improvement on this system can be realized by use of an insulative or reflective cover for the crucible which can be removed when charging or discharging the molten metal into or from the crucible. This has the advantage of avoiding the need to remove the previously mentioned skull or replacing the crucible liner before each casting is made. Another means of dealing with the radiation heat losses at the surface of the molten material may be to modify the temperature profile of the crucible either by modifying the induction coil or resistance heater design or by zone heating of the crucible to balance the heat loss at the surface of the molten material.

The holding of the molten metal such that it remains substantially quiescent is significant with respect to the elimination of solid contaminants in the molten material. The lack of any stirring or motion within the molten material allows any low density non-metallic inclusions to float to the surface where they can be disposed of or eliminated from the casting charge. Certain inclusions such as hafnium oxide have a higher density and would not ordinarily float; however, they normally attach themselves to lower density oxides which provide a net buoyant effect. Operating experience using a quiescent molten material as a source for casting indicates that the problem of solid contaminants as inclusions in the casting may be reduced by the present technique.

Refinements of the basic method of the present invention further eliminate the solid inclusions normally present in such molten materials. Preferably, the crucible in which the metal is initially melted and remains quiescent prior to pouring is a bottom pouring crucible which, because the buoyant solid inclusions are at the upper portions of the crucible, introduces that portion of the charge into the mold system last. With proper design the inclusions are contained in the head portion of the casting ingot and can be removed in subsequent operations. Alternatively, a teapot type crucible may be used which would block the floating inclusions in the crucible from entering the mold until the last portion of the charge is introduced into the system.

Another means of eliminating the buoyant inclusions in the quiescent molten metal involves the use of the insulating or reflective cover disclosed previously that prevents the solidification of metal at the surface of the molten material. Just before pouring the cover is removed allowing a thin surface layer to freeze, thus trapping inclusions in the solid material. By suitable equipment design the solidified material containing the inclusions is not attached to the crucible walls and during the tilt pouring operation the solid material pivots allowing the sub-surface molten materials to flow into the mold. Thus, the disk of soldified metal containing the trapped inclusions may be readily removed from the crucible, thus facilitating preparation of the crucible for the next alloy charge.

Conventional induction heating of the molten material in the crucible results in undesired substantial stirring of the molten metal. In order to maintain the molten material in a quiescent state, a susceptor, usually graphite, can be used between the coil and the crucible.

Using such means rapid heating of the metal is possible without stirring the molten material. Alternatively, very high frequencies or resistance heating may be employed to achieve the same results. As indicated above, the lack of stirring or motion within the melt allows any low density non-metallic inclusions to float to the surface so that the process can be tailored to eliminate such materials from the final casting.

Preferably, the temperature of the molten metal is reduced to remove up to substantially all of the superheat in the molten metal. In this preferred embodiment, the temperature should be substantially uniform throughout the molten material. It has been determined for the metals disclosed above that the temperature at the time of casting should be within 20° F. above the measured melting point or the desired microstructure is not achieved It is not known if every alloy operable with the present invention has the identical critical range of from 0° to 20° F. above the measured melting point. Based on the specific compositions disclosed herein and the observations with respect to the difference in performance where single phase alloys exhibit grain growth after casting, one skilled in the art to which this invention pertains may determine an operable casting temperature for a particular material without undue experimentation. Therefore, the criticality of the range from 0° to 20° F. is related to the effect on the microstructure and other materials or alloys may achieve the beneficial effect of the invention at casting temperatures slightly greater than 20° F. above the measured melting point.

It should also be noted that the location of temperature measurement or the means of measurement may affect the casting temperature. It is the microstructure obtained by the disclosed process that is significant and the manner in which the temperature is measured is merely the means to obtain that structure. Further, the measured melting point for the metal is determined in the apparatus used in the process for the particular charge being cast. This eliminates any disturbing influence of any variations in the actual melting point on the process. In other words, due to the very small amount of superheat allowed the actual melting point ("measured melting point") for each charge is determined and the casting temperature determined in relation to the measured melting point.

This is accomplished by melting the alloy, adding some superheat, then reducing heat input. The top surface of the melt loses heat more rapidly than the sides and bottom because the latter is in contact with the low conductivity ceramic container. As a result, the top freezes first proceeding from the periphery towards the center. A disappearing filament pyrometer or other suitable temperature measuring device is focused on the center of the melt and when the solidifying front reaches a point where the diameter of the remaining visible molten metal is about 2 inches, a temperature observation is made in this area. This is arbitrarily defined as the measured melting point of that particular charge of molten metal. The required amount of heat, if any, for the casting process is then added to balance the heat loss from the crucible and charge.

When the casting temperature is low enough and within the above-noted preferred range, the resulting casting achieves a refined cellular grain structure with a grain size of about ASTM 3 or finer. Where there is superheat in an amount in excess of the above-noted range, a coarse grained dendritic microstructure possessing inferior and more varied physical and mechanical properties results from the casting operation. Significantly this effect does not appear to relate to rapid solidification. The effect has been observed in 6" diameter castings that took ten minutes to completely solidify.

In accordance with the invention, the molten metal is next placed in a mold which includes a mold cavity and means for accelerating solidification of the metal at the entrance to the mold cavity. In the embodiments depicted in FIGS. 1 through 4, the mold includes a restricted portion 22. It is the function of this restricted portion to accelerate solidification of the metal at the entrance to the mold cavity. It is preferred that the restriction in the entrance to the mold have a diameter such that local solidification within the restriction is complete before the remaining liquid level above the restriction recedes to the level of the restriction in the mold. The size requirements of the restriction in the mold are determined by many factors influencing local solidification rates and include the specific heats and heat capacities in the mold and the metal, local heat transfer characteristics at the interfaces, the volume of liquid above and below the restriction and temperature rise of the restricted portion of the mold during the filling operation and the proportions of the mold. While the means for accelerating solidification of the metal at the entrance to the mold cavity is depicted as a restriction in the mold cavity, that is merely one means for accomplishing that result. Instead of a restriction at the entrance of the mold cavity, means for extracting heat at that location in the mold may also be used in combination or in substitution for the mold restriction.

In accordance with the invention, the entrance to the mold is blocked by solidifying metal in the entrance before solidification is complete in the remainder of the mold. In such a manner, the present invention precludes the formation of an internal void that is in flow communication with the external surface of the casting. This facilitates the elimination of any such void by HIPping.

The present invention can be more clearly described in terms of a schematic representation of the cross section of an ingot mold and resulting ingot formed in accordance with the present invention. As depicted in FIG. 1, the mold 12 defines a mold cavity in which the major portion of the casting 10 is formed and also includes a restriction 22 that forms the upper portion 24 of the casting blocking entrance of the mold and preventing flow communication between the shrinkage void 18 and the exterior portion of the casting. Also depicted in FIG. 1 is a portion of the casting 10, an interior portion 14 of the casting 10 which may have a slightly different compostion due to segregation effects upon solidification. This portion of the casting 14 also includes porosity 16 resulting from shrinkage of the molten material upon solidification. As will be disclosed below, preferred process steps can be utilized to eliminate the detrimental effects of the segregation of the molten material upon solidification.

preferably, turbulence is induced in the molten metal. For most materials it is sufficient to pour the molten metal directly into the mold. The mold may be of a metallic or ceramic material; however, when making ingots or preforms metallic molds are preferred because they prevent the inadvertent introduction of non-metallic inclusions into the casting. If the casting is to be extruded subsequent to the forming operation, a metallic mold has the additional advantage in that it can become the jacket or can surrounding the casting during the extrusion operation.

The turbulence imparted to the mixture may be accomplished in a number of different ways. Turbulence may be induced in the molten metal while the mixture is within the mold. This can be accomplished by electromagnetic stirring. The turbulence may be imparted to the molten metal just prior to its introduction into the mold by mechanical means. For example, the turbulence can be induced by breaking the molten metal into a plurality of streams or droplets at a location adjacent the entrance to the mold. This can be accomplished by the use of strainer cores or turbulators which will form the molten metal into the streams or droplets of the appropriate size. Alternatively, a nozzle may be used as a portion of a crucible that would impart a helical motion to the stream tending to break it into coarse droplets for the purpose of extracting heat from the solidifying alloy by increasing its surface-to-volume ratio.

In accordance with the invention the molten metal is solidified in the mold by extracting heat therefrom at a rate to obtain a substantially equiaxed, cellular, nondendritic grain structure thoughout the article and avoid the presence of a dendritic columnar grained zone. As the aspect ratio of the mold decreases, it is increasingly important to extract heat more rapidly from the solidifying molten mixture to maintain the fine grain size and associated cellular structure and to minimize the increasing tendency for porosity and possible segregation. This is facilitated by the previously disclosed means of increasing the surface-to-volume ratio of the molten metal during the pouring operation by breaking the stream into a number of smaller streams or into large droplets. In such a manner the molten metal is solidified at a rate that would result in the desirable microstructure for the article, specifically, an equiaxed cellular grain structure having an ASTM grain size of about 3 or finer. As noted above the desirable effect on the structure may be obtained without extremely high solidification rates, although extremely low solidification rates would normally be expected to increase the grain size.

In some instances, the initial temperature gradient between the liquid metal and a relatively cold mold is sufficiently high to yet produce a zone of dendritic columnar grains at the surface It has been determined that by increasing the ceramic or metal mold temperature that any remaining traces of columnar dendritic grain may be significantly reduced or eliminated.

Figure 2:
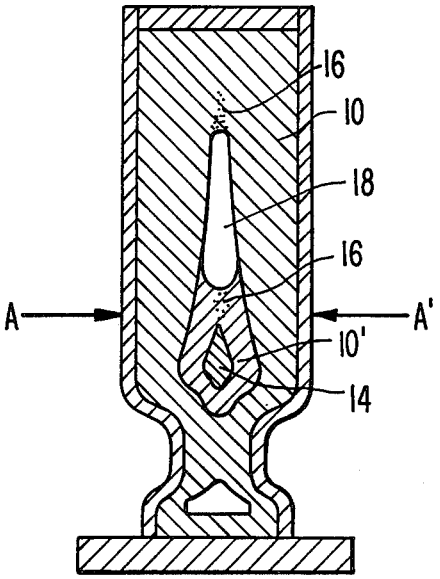
Figure 3:
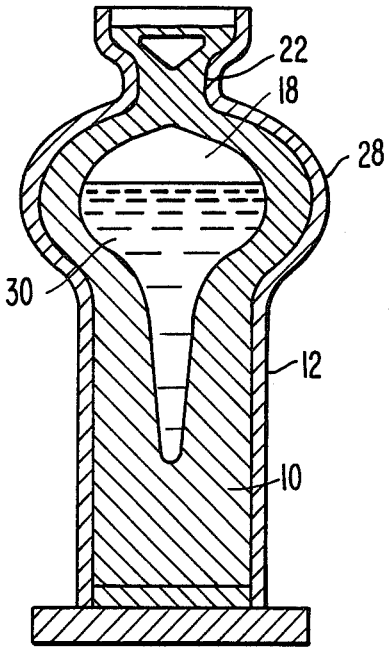
Figure 4:
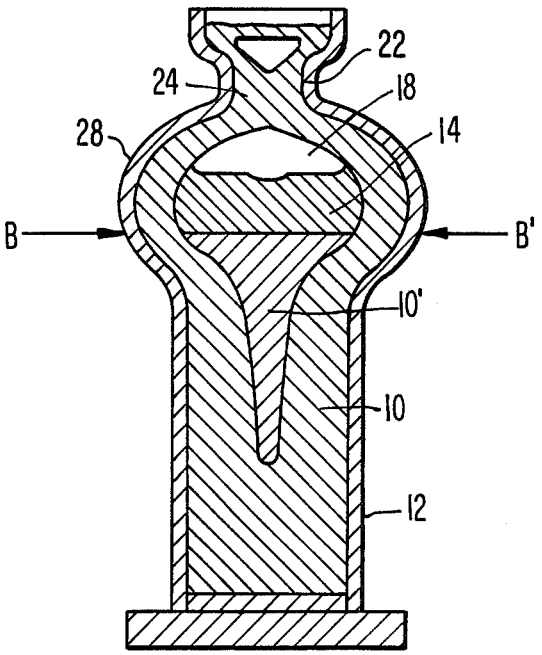

FIGS. 2 through 4 illustrate a preferred method of operating the present invention wherein in accordance with the invention the mold is inverted prior to complete solidification of the metal such that a minor portion of the metal is still molten. As a result, the minor portion of molten metal flows into the shrinkage void beneath the mold entrance. As depicted in FIG. 2, the resulting casting is comprised of a cast portion 10 having the desired microstructure. The portion 10' is comprised of a portion of molten metal that flowed from the interior of the casting to the shrinkage void at the top of the mold when the mold was inverted and has solidified. Because of the mixing caused by the inversion the portion 10' has not segregated and has the desired composition and microstructure. Within the portion 10' there is an addition portion 14 of the casting that was last solidified. Because the portion 14 solidified last, it may include detrimental segregation. While the portions 14 and 10' are depicted as distinct portions in actuality, there may not be a sharp distinction between the region. In any event, inversion of the mold prior to solidification reduces segregation in the last material solidified even if not all the last solidified material is unsegregated. Thus, the inversion both induces homogeneity as well as isolates any segregated material in a known location in the mold.

By manipulating the ingot in such a fashion, there is produced above the line defined by the arrows A and A' an ingot having the desired composition and microstructure with an internal void that is not in flow communication with the exterior of the casting. Such a casting can be trimmed along the line defined by the arrows A and A' after being subjected to HIPping to form an ingot having the desired composition and microstructure at full density. The portion of the casting having undesirable segregation 14 is contained in the portion of the ingot that is trimmed and rejected from further processing. Alternatively to trimming and hot isostatically pressing, the ingot shown in the form depicted in FIG. 2 could be subjected to hot isostatic pressing and then trimmed to eliminate the portion having undesirable segregation 14. This method is preferred because trimming the ingot prior to HIPping may open interconnected porosity that would prevent effective HIPping of the ingot.

A variation of the present invention is to provide the mold 12 with a mold cavity having excess capacity adjacent the shrinkage void in the ingot. As depicted schematically in FIGS. 3 and 4, the mold 12 includes an enlarged portion 28 adjacent the entrance of the mold 12. As depicted in FIG. 3, the molten material solidifies within the restriction 22 in the mold thereby leaving the molten portion 30 remaining within the central portion of the casting with a relatively large amount of molten material within the enlarged portion 28 of the mold.

FIG. 4 schematically depicts the ingot upon solidification whereupon the portion of the casting that has solidified after sealing the entrance to the mold is shown as two different portions The portion 10' has the same basic composition as the remainder of the casting. Portion 14, however, has some segregation present due to the segregation effects upon solidification. Upon the HIPping of the casting, however, the elimination of the void 18 will result in a reduction in the overall size of the ingot. However, the excess capacity of the ingot by the use of the enlarged portion 28 will compensate for the reduction in volume associated with elimination of the central void at that portion of the casting. Similar to the trimming of the ingot of FIG. 2, the ingot of FIG. 4 may be trimmed at the line defined by the arrows B and B' in FIG. 4 to eliminate the portion 14 of the casting that may include segregation. Preferably, where the ingot is not inverted, the volume of the excess capacity in the mold is approximately the same volume as the shrinkage void. Where the ingot is inverted, it is preferred that the volume of the excess capacity in the mold be approximately the same volume as the remaining liquid metal present in the casting at the time of inversion. It is further preferred that when the ingot is inverted that the molten portion comprised from about 5 to 15 volume percent of the solidified portion at the time of inversion of the casting. In such a manner, the heat content of the molten portion is such that the later solidifying material will have the desired microstructure as well as minimizing the segregation effects upon solidification.

In accordance with the invention, the casting is then subjected to hot isostatic pressing whereupon the shrinkage void and any porosity are eliminated by combined effects of pressure and temperature. While the parameters of the HIPping process may detrimentally effect the desired microstructure, one skilled in the art to which the invention pertains can determine the parameters of the HIPping step without a specific teaching in the present specification.

It is further preferred that during the solidification of the molten portion after the blockage of the entrance to the mold that the molten portion be mixed. Such mixing can take place by repeatedly inverting the casting or by physical agitation. It is also possible to apply a radio frequency electric field to the molten portion at a frequency disposed to mix but not heat the molten metal.

The present invention has been used in several specfic examples. In these examples two metal alloys (identified as A and B respectively) were used having the following compositions:

| | Ni | Co | C | Cr | Mo | W | Ti | Al | Ta | Cb | Hf |
|---|---|---|---|---|---|---|---|---|---|---|---|
| Alloy A | BAL | 8 | 0.04 | 14 | 3.5 | 3.5 | 2.5 | 3.5 | — | 3.5 | — |
| B | BAL | 9 | 0.09 | 12.4 | 2 | 3.8 | 4 | 3.5 | 4 | — | 0.8 |

EXAMPLE No. 1

Ingots were cast in both alloys A and B using an hourglass restriction with a 3" diameter where the ingot measured 5½" in diameter and 12" long. Subsequently, the casting with the restriction in place was HIPped at 2090° F., 15KSI, for 4 hours (alloy A) and 2165° F., 25KSI, for hours (alloy B) to densify the ingot without recrystallization and grain growth (which occurs when higher temperatures are employed). Subsequent sectioning and analysis revealed the material to be fully dense, thus confirming that the restriction was effective.

EXAMPLE No. 2

When the mold height was increased to 32" again using a 5½" diameter mold and a 3" diameter restriction alloy B was employed under equivalent processing conditions. Several ingots were cast with the result that a ¾" diameter porous zone remained at the restriction centerline and densification by HIPping was not possible without an additional sealing operation.

EXAMPLE No. 3

When example 2 was repeated with a 2" diameter restriction several excellent ingots were produced which were fully dense after HIPping using the parameters of Example 1.

EXAMPLE No. 4

A large ingot 11½" in diameter and 20" long was cast in alloy B using a restriction 4" in diameter. Inspection indicated that the center portion was sealed.

EXAMPLE No. 5

A three inch diameter mold with one inch throat was used to cast an ingot of alloy B. The mold was inverted after approximately one minute. The throat area was assumed to have solidified as no liquid metal was discharged from the top of the mold. The ingot was HIPped at 2165° F./25 KSI for 4 hours and the external dimensions measured before internal examination. A void was created in the lower portion of the ingot when the mold was inverted (as determined by a measurable decrease in outside diameter after HIPping) and the resultant centerline section remained fine grained. In addition the presence of undesirable phases (i.e., eta) was avoided.

The present invention has been disclosed in terms of preferred embodiments and the scope of the invention is not limited thereto. The scope of the invention is determined by the appended claims and their equivalents.

What is claimed is:

1. A method of casting a metal ingot having a substantially eqiaxed grain, cellular, nondendritic microstructure uniformly through said ingot, said method comprising the steps of:

(a) melting a metal to form a molten metal;

(b) reducing the temperature of said molten metal to remove almost all of the superheat in said molten metal to form a molten casting metal consisting of liquid metal;

(c) placing said molten casting metal in a mold, said mold including a mold cavity and means for accelerating solidfication of metal at the entrance to said mold cavity;

(d) blocking the entrance to said mold by solidifying said molten casting metal in said entrance before solidification is complete in the remainder of said mold cavity;

(e) solidifying said molten casting metal in said mold by extracting heat therefrom at a rate to solidify said molten casting metal to form said ingot having said microstructure, said ingot having a shrinkage void beneath the blocked entrance to said mold; and (f) hot isostatically pressing said ingot to eliminate voids within said ingot.

2. The method of claim 1 wherein said means for accelerating solidfication of said molten casting metal at the entrance to said molten comprises a restriction at the entrance to said mold cavity.

3. The method of claim 1 including the step of providing said mold cavity with excess capacity adjacent the said shrinkage void in said ingot.

4. The method of claim 3 wherein the volume of said excess capacity is approximately the same volume as said shringage void.

5. The method of claim 4 wherein said hot isostatic pressing step produces an ingot having a substantially uniform exterior shape.

6. A method of casting a metal ingot having a substantially equiaxed grain, cellular nondendritic microstructure uniformly throughout said ingot, said method comprising the steps of:

(a) melting a metal to form a molten metal;

(b) reducing the temperature of said molten metal to remove almost all of the superheat in said molten metal to form a molten casting metal consisting of a liquid metal;

(c) placing said molten casting metal in a mold, said mold including a means for acelerating solidification of metal at the entrance of said mold;

(d) blocking the entrance to said mold by solidfying said molten casting metal in said entrance;

(e) solidifying only a major portion of said molten casting metal in said mold by extracting heat therefrom at a rate to solidify said molten casting metal to form said ingot having said microstructure, said ingot having a shrinkage void beneath the blocked entrance to said mold;

(f) inverting said mold prior to complete solidification of said molten casting metal when a minor portion of said casting metal is still molten whereby said minor portion of molten casting metal flows into said shrinkage void beneath said mold entrance;

(g) solidifying said minor portion within said shrinkage void;

(h) hot isostatically pressing said ingot to eliminate voids within said ingot; and (i) trimming said ingot to remove said solidified minor portion from said ingot.

7. The method of claim 6 wherein said means for accelerating solidification of metal at the entrance to said mold comprises a restriction at the entrance to said mold cavity.

8. The method of claim 6 wherein said molten portion comprises from about 5 to 15 volume percent of said solidified portion when said mold is inverted.

9. The method of claim 6 including the step of providing said mold cavity with excess capacity adjacent the said shrinkage void in said ingot.

10. The method of claim 9 wherein the volume of said excess capacity is approximately the same volume as said minor portion of molten casting metal upon initiation of said inverting step.

11. A methodof casting a metal ingot having a substantially equiaxed, cellular nondendritic microstructure uniformly throughout said ingot, said method comprising the steps of:

(a) melting a metal to form a molten casting metal consisting of liquid metal;

(b) reducing the temperature of the molten casting metal to remove almost all of the superheat in said molten casting metal;

(c) plaing said molten casting metal in a mold, said mold including a means for accelerating solidification of metal at the entrance to said mold;

(d) blocking the entrance to said mold by solidifying said molten casting metal in said entrance before solidication is complete in the remainder of said mold;

(e) solidifying only a major portion of said molten casting metal in said mold by extracting heat therefrom at a rate to solidify said molten casting metal to form said ingot having said mcirostructure, said ingot having a shrinkage void beneath the blocked entrance to said mold;

(f) inverting said mold prior to complete solidification of said molten casting metal when a minor portion of said casting metal is still molten whereby said minor portion of molten casting metal flows into said shrinkage void beneath said mold entrance;

(g) mixing said minor portion of molten casting metal within said shrinkage void to reduce segregation in said portion;

(h) solidifying said minor portion within said skringage void; and (i) hot isostatically pressing said ingot to eliminate void within said ingot.

12. The method of claim 11 wherein said mixing step comprises applying a radio frequency electric field to said molten portion at a frequency disposed to mix said molten metal.

13. The method of claim 11 wherein said means for accelerating solidification of said metal at the entrance to said mold comprises a restriction at the entrance to said mold cavity.

14. The method of claim 11 wherein said molten portion comprises from 5 to 15 volume percent of said solidified portion when said mold is inverted.

15. The method of claim 11 including the step of providing said mold cavity with excess capacity adjacent the said shrinkage void in said ingot.

16. The method of claim 15 wherein the volume of said excess capacity is approximately the same volume as said minor portion of molten metal upon initiation of said inverting step.

* * * * *

UNITED STATES PATENT AND TRADEMARK OFFICE

CERTIFICATE OF CORRECTION

PATENT NO. : 4,709,461

DATED : December 1, 1987

INVENTOR(S) : WILLIAM R. FREEMAN, JR.

It is certified that error appears in the above-identified patent and that said Letters Patent is hereby corrected as shown below:

Claim 1, column 12, line 10, change "eqiaxed" to --equiaxed--;

column 12, line 20, change "solidfication" to --solidification--.

Claim 4, column 12, line 43, change "shringage" to --shrinkage--;

Claim 6, column 12, line 57, change "acelerating" to --accelerating--;

column 12, line 59, change "solidfying" to --solidifying--.

Claim 11, column 13, line 25, change "methodof" to --method of--;

column 13, line 34, change "plaing" to --placing--;

column 14, line 1, change "solidication" to --solidification--;

column 14, line 6, change "mcirostructure" to --microstructure--;

UNITED STATES PATENT AND TRADEMARK OFFICE

CERTIFICATE OF CORRECTION

PATENT NO. : 4,709,461

DATED : December 1, 1987

INVENTOR(S) : WILLIAM R. FREEMAN, JR.

It is certified that error appears in the above-identified patent and that said Letters Patent is hereby corrected as shown below:

Claim 11, column 14, lines 17-18, change "skringage" to --shrinkage--.

Signed and Sealed this

Ninth Day of August, 1988

*Attest:*

*Attesting Officer*

DONALD J. QUIGG

*Commissioner of Patents and Trademarks*